United States Patent [19]

Naraki et al.

[11] Patent Number: 4,671,749

[45] Date of Patent: Jun. 9, 1987

[54] SCREW COMPRESSOR

[75] Inventors: Kazuhide Naraki; Yoshiyuki Nishimura, both of Kobe; Shoji Yoshimura, Hyogo, all of Japan

[73] Assignee: Kabushiki Kaisha Kobe Seiko Sho, Kobe, Japan

[21] Appl. No.: 751,586

[22] Filed: Jul. 3, 1985

[30] Foreign Application Priority Data

Jul. 4, 1984 [JP] Japan ..... 59-101748[U]

[51] Int. Cl.[4] ..... F04C 18/16

[52] U.S. Cl. ..... 418/149; 418/201

[58] Field of Search ..... 418/149, 201-203

[56] References Cited

U.S. PATENT DOCUMENTS

| | | | |
|---|---|---|---|
| 1,164,546 | 12/1915 | Neuland | 418/201 |
| 2,362,106 | 11/1944 | Ungar | 418/201 |
| 3,695,790 | 10/1972 | Jones | 418/149 |
| 3,814,557 | 6/1974 | Volz | 418/201 |
| 4,020,642 | 5/1977 | Haselden | 418/201 |
| 4,042,310 | 8/1977 | Schibbye | 418/201 |
| 4,234,296 | 11/1980 | Matsubara | 418/201 |
| 4,394,113 | 7/1983 | Bammert | 418/201 |

FOREIGN PATENT DOCUMENTS

| | | | |
|---|---|---|---|
| 129793 | 10/1981 | Japan | 418/201 |
| 159594 | 12/1981 | Japan | 418/201 |
| 143186 | 9/1982 | Japan | 418/149 |

*Primary Examiner*—Carlton R. Croyle
*Assistant Examiner*—Jane E. Obee
*Attorney, Agent, or Firm*—Oblon, Fisher, Spivak, McClelland & Maier

[57] ABSTRACT

A screw compressor which a casing defining therein a pair of cylindrical chambers axially intersected, and a pair of male and female screws in an intermeshing relationship. The casing includes an inlet port having a profile composed of an open area fully open to the chambers and the remaining solid area occupied with one portions of shafts of the screws and with one portion of the casing, said profile being equal to a profile of the chambers, such that the fluid can flow freely into the chambers without causing turbulent fluid flow.

3 Claims, 10 Drawing Figures

SCREW COMPRESSOR

BACKGROUND OF THE INVENTION

1. Field of the Invention

The present invention relates to a screw compressor for increasing the pressure of a gas, vapor or mixture of the gases and vapors, and more particularly a compressor casing for accomodating a pair of intermeshing rotors or screws.

2. Description of the Prior Art

There is one known compressor generally comprising a casing defining therein a pair of cylindrical chambers axially intersected with each other, and a pair of male and female screws rotatably mounted in the respective chambers for counterrotation in an intermeshing relation with each other. A typical compressor of this type is illustrated in FIGS. 7 and 8. The casing includes a rotor casing body 1 having therein the cylindrical chambers or space, an inlet casing 6 having therein an inlet port 21, and an exit or delivery casing 3 providing an exit port 32, in cooperation with the casing body 1. The inlet and exit ports 61,32 are disposed at axially opposite ends of the chambers 14,15, respectively, the two ports being in communication with the latter. The inlet and exit casings 6,3 have respective end surface 63,30 extending perpendicularly with respect to the parallel axes of the chambers 14,15 at the opposite ends, respectively. The inlet casing 2 includes a pair of parallel tubular walls 62 and an end wall partitioning partially the inlet port 61 extending around the tubular walls 62 apart from the chambers. The end wall has a closure end surface 9 serving to close the chambers 14,15 at one ends thereof. The exit casing 3 has an end surface 30 serving to close the chambers at the other ends thereof. The exit port 32 extends from a corner portion of the chambers 14,15 outwardly with a cross-sectional area which progressively increases. The male and female screws 4,5 have shafts 40, 50 extending coaxially with respect to the respective axes of the chambers and rotatably received in the inlet and exit casings 2,3. The two shafts are operatively coupled to drive means (not shown) for rotation via gearings and other coupling means (not shown). The male screw 4 has a plurality of helical lobes or teeth 41 and helical tooth grooves 41*a* extending in parallel along the axis thereof, while the female screw 5 has a plurality of helical grooves 51 extending along the axis thereof, the respective teeth intermeshing with the respective corresponding grooves in an axial space extending along an intermediate vertical plane in which the chambers 14,15 are intersected.

In operation the two screws counterrotate in a constant intermeshing engagement relationship with each other. The gas is sucked or rammed axially into the chambers 14,15 through the inlet port and enclosed or trapped within the chambers in the tooth grooves and the grooves. The compressed gas is then discharged or delivered from the chambers through the exit port 3 in a known manner. In such an axial flow compressor having the inlet port 61 disposed axially upstream of the chambers 14, 15, the gas generally yields an inertia supercharge effect when it is sucked axially into the gas chambers, with the result that the gas specific suction volume becomes greater than the actual gas suction volume. The prior compressor, however, has a drawback in that the end surface 63 extends over a position in which the inertia supercharge effect occurs. This arrangement tends to hinder the inertia inward flow of the gas, thus impairing such an advantageous effect. The hindered gas causes a tubulent flow of the gas in the inlet port 61, which leads to greater loss of energy during the suction process. Such a known inlet casing has the end surface 63 which makes the construction of the inlet casing become objectionably complicated, thus requiring elongated time and tedious work for manufacturing it.

SUMMARY OF THE INVENTION

According to the present invention, a screw compressor for increasing the pressure of the gas comprises a casing inculding a casing body defining a pair of parallel cylindrical chamber axially intersected with each other and having axially opposite ends, a front or inlet casing member disposed at one end of the casing body and having an inlet port communicating with the chambers, and a rear or exit casing member disposed at the other end of casing body for closing the other end and providing an exit port communicating with the chambers; a female screw including a first shaft operatively connected to drive means for rotation, and a plurality of helical grooves extending in substantially parallel relation with one another about the first shaft, the grooves being accommodated within one of the pair chambers for rotation in one direction about the axis of the first shaft; a male screw including a second shaft operatively connected to the drive means for rotation, and a plurality of helical teeth extending in parallel about the axis of the second shaft, the teeth being accommodated in the other one of the chambers for rotating in the other direction about the axis of the second shaft, each of the teeth being adapted to counterrotate in an intermeshing engagement with one of the grooves; and the inlet port including an aperture open to the chambers along a full vertical region hereof and having an area substantially equal to a cross-sectional area the chambers for thereby enabling the gas to flow freely into the chambers without causing an objectionable turbulent gas flow.

It is therefore an object of the present invention to provide a screw compressor enabling an improved rate of compressed gas production, particularly by improving an supercharging effect in the gas suction process with a reduced energy loss.

Another object of the present invention is to provide a compressor having a suction or inlet casing of a simple construction.

Many other advantages, features and additional objects of the present invention will become manifest to those skilled in the art upon making reference to the detailed description and the accompanying drawings in which preferred embodiments incorporating the principles of the present invention are shown by way of illustrative example.

DESCRIPTION OF THE PREFERRED EMBODIMENTS

Figure 1:
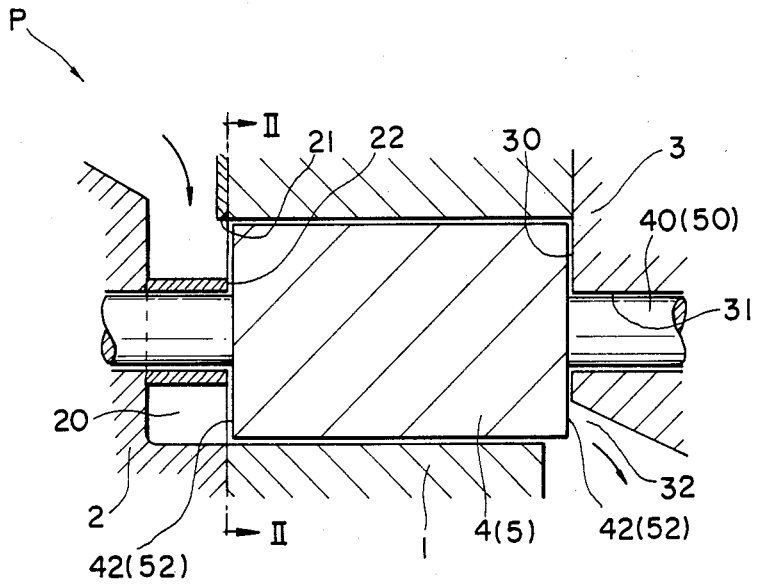
FIG. 1 is a schematic and fragmentary vertical cross-sectional view of fa compressor according to a first embodiment of the present invention.

FIG. 1 shows schematically a casing portion of a compressor P according to a first embodiment of the present invention.

Figure 7:
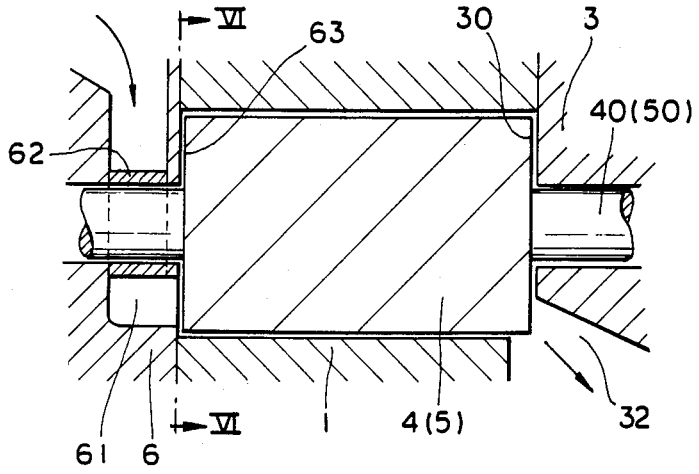
FIGURE 7 PRIOR ART
FIG. 7 is a vertical cross-sectional view similar to FIGS. 1 and 3, showing a prior known compressor.
Figure 8:
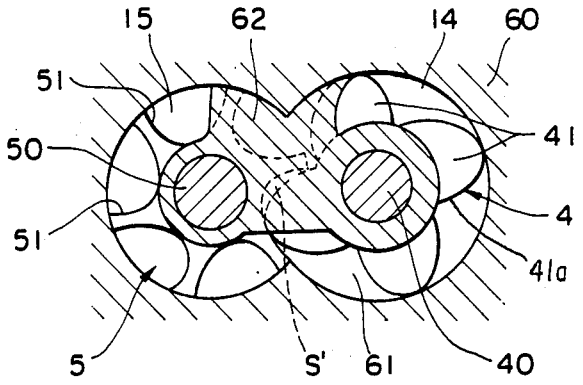
FIGURE 8 PRIOR ART
FIG. 8 is a vertical cross-sectional view taken along a line VII—VII of FIG. 7.

Hereinbelow, parts or portions similar in function and construction to the exemplary prior compressor in FIGS. 7 and 8 are indicated by the same numerals as those of the prior compressor.

The compressor P includes a casing body 1 defining therein a pair of cylindrical cavities or chambers 14,15 axially intersected with each other, and a pair of male and female rotors of screws 4,5 rotatably received in the corresponding one of the chambers, the two screws being in intermeshing relation to each other. A pair of casing members, i.e. a front or inlet casing 2 and a rear or exit casing 3, are disposed at opposite ends of the casing body 1, respectively, and serve to close the opposite ends of the casing body 1. The male and female screws 4,5 have respective shafts 40, 50 extending axially therefrom through the mating chambers 14,15 and the inlet and exit casings 2,3, respectively. The shafts 40, 50 are rotatably supported by bearings (not shown) in the respective casings 2,3, and are operatively connected to drive means (not shown) for rotation.

Figure 2:
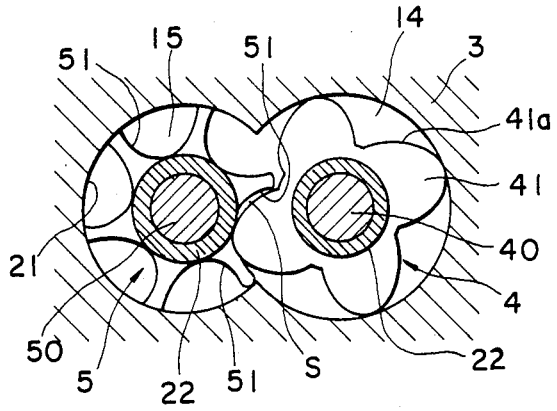
FIG. 2 is a vertical cross-sectional view taken along a line II—II of FIG. 1.

As shown in FIG. 2, the male screw 4 includes four alternate helical teeth 41 and tooth grooves **41*a* extending in parallel with one another around the axis of the shaft 40 integral therewith, and end surfaces 42 at opposite ends thereof. The respective tooth grooves are formed by a respective adjacent pair of tooth flanks. The female screw 5 has six helical grooves 51 extending parallel around the axis of the shaft 50 integral therewith, and end surfaces 53 at the respective opposite ends. As the shafts 40, 50 are driven to counterrotate in directions indicated by arrows R (in FIGS. 5A to 5C), the respective one tooth 41 is engagable with the respective one groove 51 in the intermeshing relationship within an axial space extending along an intermediate vertical plane in which the pair of the chambers 14,15 are intersected. The thus intermeshed tooth 41' and groove 51'** provides a closed space S therebetween.

The number of the teeth and the grooves are not limited to four and six, respectively, and may be increased or reduced.

The inlet casing 2 includes a first casing seal member 21 for producing a seal in cooperation with the casing body 1 therebetween, and a pair of second seal members 22 for sealing one portion in the respective one end surfaces 42, 52 of the screws, as best shown in FIG. 1, and further for receiving therein the respective shafts 40, 50. The inlet casing also includes an opening or inlet port 20 disposed therein downstream of said sealing member 21 around the peripheries of the second seal members 22 and positioned upstream of an axial end of said female and male screw. The inlet port 20 has a cross-sectional area equal in size to that of the combined cross-sectional areas of chambers 14, 15. with the exception of a pair of circular areas being substantially equal in area to the vertical cross-sectional area of the second seal members 22 and the shafts 40, 50.

The exit casing 3 has an end surface 30 closing transversely the other end of the casing body 1 and hence the chambers 14,15, and a pair of bores 31 (only one being shown) for receiving the shafts 40, 50 for rotation, respectively. The exit casing 3 provides an opening or exit port 32 in cooperation with the casing body 1. The exit port 32 is open to the chambers 14,15 and extends axially and radially therefrom.

In operation, the two shafts 40, 50 of the male and female screws 4,5 are driven to counterrotate for enabling successive adjacent pairs of teeth 41 and grooves 51 to progressively intermesh with each other so as to provide the closed space S therebetween one after another. When the two screws counterrotate, a mass of the gas disposed in one tooth groove **41*a* and one groove 51 is displaced progressively toward a downstream end of the chambers 14,15 and hence the exit casing 3. Simultaneously, a mass of the gas in the inlet port 21 adjacent to the preceding mass of the gas is sucked progressively into the chambers. As the gas enclosed in the chambers 14,15 is forced to trace or follow the tooth grooves 41*a* and the grooves 51, the gas is compressed prior to being discharged from the chambers through the exit port 32** in a known manner.

Figure 5A:
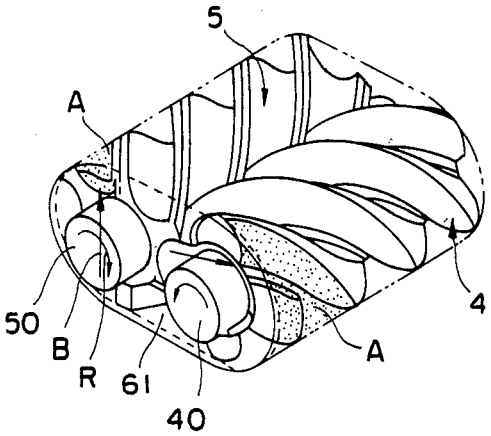
FIGS. 5A, 5B and 5C are fragmentary perspective views of the compressor, partly omitted, showing progressive steps in which sucked gas is progressively displaced by a pair of screws.
Figure 5B:
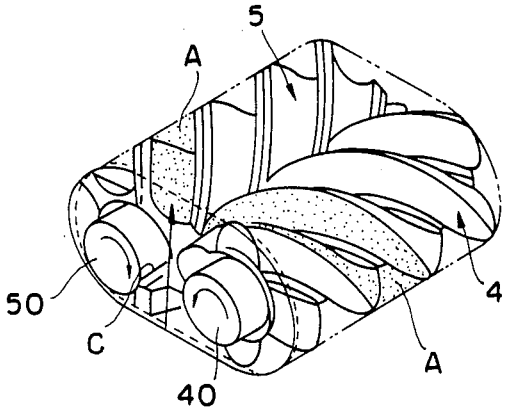
Figure 5C:
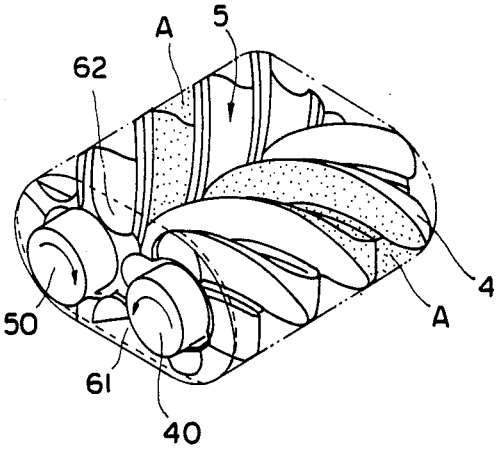

With reference to FIGS. 5A to 5C, advantageous features of the compressor P according to the present invention are described hereinbelow in comparison with the prior known compressor shown in FIGS. 7 and 8.

FIGS. 5A, 5B and 5C illustrate successive steps of gas suction and compression by tracing progressive movement of a mass of the gas in one displaceable region A (illustratively shadowed in the drawings) defined within the chambers 14,15 by one associated pair of a grooves 51 and an adjacent pair of tooth flanks of the female and male screws 5,4.

FIG. 5A shows a first step in which the gas disposed within the chambers 14,15 in the region A is being displaced or sucked into the further interior portion of the chambers.

FIG. 5B shows a second step in which the suction of the gas has just been completed, and the region A is is axially progressed. In the prior compressor, at that time, the axially progressed region A is closed off from the inlet port by the closure end surface (in FIG. 8).

FIG. 5C shows a third step in which the gas is under compression in the region A which is spaced apart from the closure end surface 62 and enclosed by the adjacent groove and tooth pair. In the prior compressor of FIGS. 7 and 8, theoretical displacement or volume displaced by the screws 4,5 can be shown by the shadowed region A of FIG. 5B, while in the present compressor P theoretical displacement thereof can be shown by the shadowed region A of FIG. 5C which is now spaced apart from the enclosure surface 62 and enclosed by the two screws 4, 5.

When the region A is transferred from a position shown in FIG. 5B to a position shown in FIG. 5C, i.e. from the second step to the third step, the gas displacement tends to be reduced slightly as the screws 4,5 counterrotate in the compressor P according to the present invention. Such a reduced amount of the volume can be compensated for by providing an increased length of the screws or rotors and by increasing the wrap angle of the screws.

When the prior compressor starts the suction process, one associated pair consisting of a tooth 41 and a groove 51 the male and female screws has substantially no opening space S' therebetween in a vertical plane at their upstream ends. As the screws counterrotate slightly and provide a space S' in FIG. 8, the space being closed by the tooth groove of the male screw 4 and the groove of the female screw 5 yields a large pressure decrease relative to the pressure of the inlet port, which causes a negative torque acting on the screws 4,5. In contrast, the compressor P of the present invention does not undergo such an objectionable effect, since the space S is open to the inlet port defined by such an open structure of the inlet casing 2. As a result, the compressor P enables the gas to flow freely into the chambers 14,15 in directions indicted by arrows B and C while the screws 4,5 counterrotate.

Figure 6:
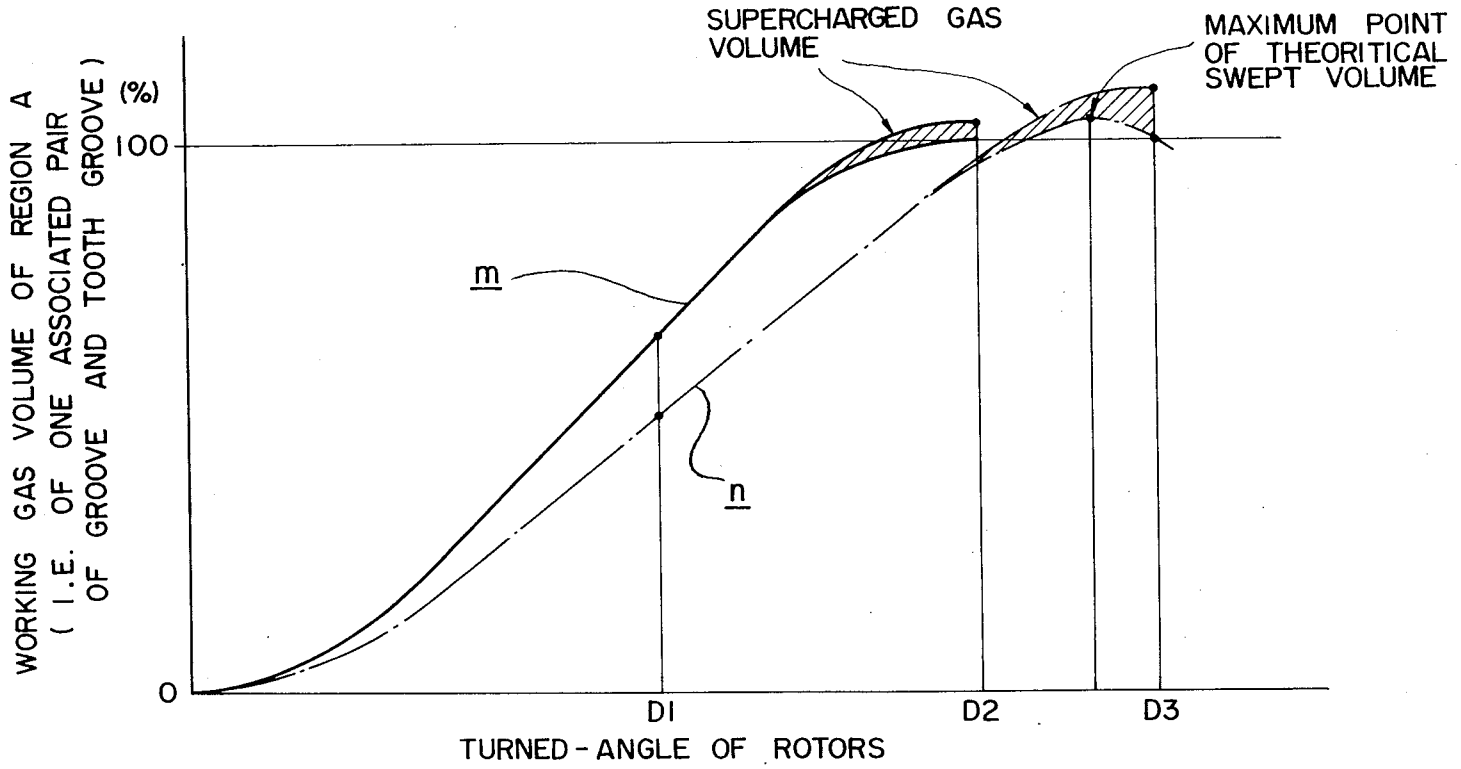
FIG. 6 is a curvilinear graph showing the volume change of a region defined in one associated pair of groove and tooth groove of respective pairs of male and female screws both in the prior art compressor and the compressor according to the present invention.

FIG. 6 illustrates two curves each showing the relation between the volume and rotation of the rotor, and more particularly between a working gas volume in one associated groove and tooth groove pair, i.e. in region A and a turned-angle of the rotors with respect to both the conventional compressor and the present compressor. A solid line m illustrates the prior screw compressor, while a dot-and-dash line n illustrates the screw compressor according to the present invention.

D1 is a first turned-angle of the screws 4,5 corresponding to the first step shown in FIG. 5A, in which the gas is being sucked into the chambers 14,15 both in the prior and present screw compressors.

D2 is a second turned-angle of the screws 4,5 corresponding to the second step shown in FIG. 5B. At that time, the prior compressor has just completed the gas suction, while the present compressor continues to suck the gas.

D3 is a third turned-angle of the screws 4,5 corresponding to the third step shown in FIG. 5C, whereupon the gas is now being compressed in the prior compressor, while the present compressor has just completed the gas suction.

Figure 3:
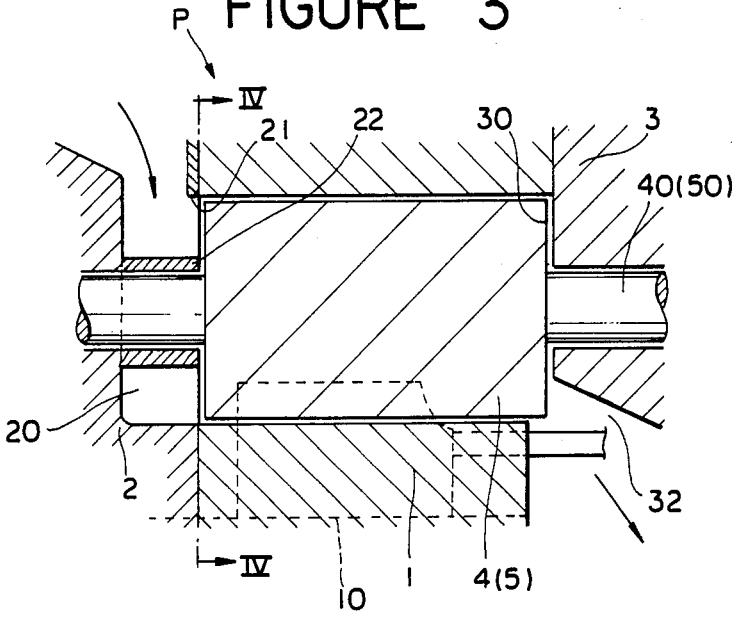
FIG. 3 is a vertical cross-sectional view similar to FIG. 1, showing a second embodiment of the present invention.
Figure 4:
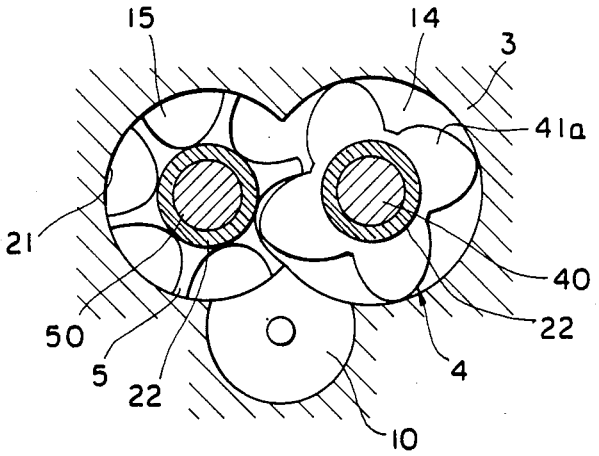
FIG. 4 is a vertical cross-sectional view taken along a line IV—IV of FIG. 3.

FIGS. 3 and 4 show a compressor according to a second embodiment of the present invention, which is similar to the first embodiment of FIGS. 1 and 2 except that a slidable delivery valve 10 is provided as shown by broken lines in FIG. 3. The second compressor P' has the same function as the first embodiment.

According to the present invention, the compressor P, P' has no such obstacle corresponding to the enclosure end surface 63 (in FIG. 7) which tends to hinder the the inward flow of the gas because of the fully open inlet port 20 in the present invention. As the result, the gas can be supercharged into the space S when the screws 4,5 are in the condition shown in FIG. 5B, which leads to an increase of output volume of the compressed gas. Accordingly, the present compressor P, P' can reduce an objectionable energy loss in the suction process, thus yielding improved power efficiency. In addition, the structural simplicity of the inlet casing can also reduce the manufacturing cost thereof.

When the principles of the present invention is embodied in a small sized screw compressor which tends to have a gas suction resistance and a gas delivery resistance, such resistance can be reduced by providing an axially elongated casing body which allows an increase in the cross-sectional area of the inlet and exit ports, and which further leads to an increase in suction time, with the result that the velocity of the inward flow of the gas decreases and the gas suction resistance is reduced. Further, a negative torque on the screws as described above does not occur, thus saving energy in the suction process.

Hereinbelow, the screw compressor according to the present invention will be compared with one conventional screw compressor by describing an example of performance test results of the two screw compressors:

1. Specifications

| | conventional screw compressor | present screw compressor |
|---|---|---|
| type | oilless | oilless |
| male rotor diameter | 71 mm | 71 mm |
| female rotor diameter | 65 mm | 65 mm |
| distance between the axes of male and female rotors | 52 mm | 52 mm |
| theoretical swept volume | 264 $m^3/h$ | 264 $m^3/h$ |
| revolution speed (of male rotor) | 24,000 rpm | 24,000 rpm |
| built-in pressure ratio | 2.4 | 2.4 |
| length/diameter ratio | 1.0 | 1.2 |
| wrap angle of male rotor | 270° | 324° |

2. Running Conditions (common to the two compressors)

| | |
|---|---|
| suction pressure | 3.35 $kgf/cm^2$ absolute |
| discharge pressure | 9.03 $kgf/cm^2$ absolute |
| suction temperature | 45° C. |
| compressed gas | air |

3. Running Test Results

| | conventional screw compressor | present screw compressor |
|---|---|---|
| discharge volume | 180 $m^3/h$ | 191 $m^3/h$ |
| shaft input power | 33.2 kW | 32.0 kW |
| discharge temperature | 197° C. | 191° C. |

As is obvious from the test results, the screw compressor according to the present invention has more advantages in producing the compressed air than the conventional screw compressor.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A screw compressor utilizing drive means for rotation of said compressor and for increasing the pressure of a fluid, said compressor comprising:

(a) a casing including a casing body defining therein first and second parallel cylindrical chambers axially intersected with each other and having axially opposite ends, an inlet casing member disposed at a first end of said casing body and having a casing seal member and an inlet port positioned downstream of said casing seal member for communicating with said chambers, and an exit casing member disposed at a second end of said casing body opposite said first end for closing said second end and providing an exit port communicating with said chambers;

(b) a female screw completely axially housed within said casing body and including a first shaft operatively connected to the drive means for rotation, and a plurality of helical grooves extending substantially parallel with one another about an axis of said first shaft, said grooves being accommodated within said first chamber for rotating about said axis of the first shaft;

(c) a male screw completely axially housed within said casing body including a second shaft operatively connected to the drive means for rotation, and a plurality of alternate helical teeth and tooth grooves substantially in parallel with one another and extending about the axis of said second shaft, said tooth grooves being accommodated within said second chamber for rotating about said axis of said second shaft, said teeth of the male screw and said grooves of the female screw being adapted to counterrotate in an intermeshing relation with each other, and wherein said inlet casing further comprises a first and second tubular seal member for sealing said first and second shafts, respectively, (d) said inlet port being positioned exclusively upstream of said female and male screw members and having a cross-sectional area equal to a combined cross-sectional area of said first and second chambers less a cross-sectional area of said first and second tubular seal members and said first and second shafts, and wherein said inlet port is positioned axially upstream of said female and male screw and has positioned therein said first and second tubular seal members, such that the fluid is allowed to flow freely into said chambers without causing a tubulent fluid flow wherein only said first and second tubular seal members and portions of said first and second shafts are positioned in said inlet port.

2. A screw compressor according to claim 1, wherein said female screw has six grooves formed therein, and said male screw has four teeth.

3. A screw compressor according to claim 1, further comprising a slidable delivery valve slidably mounted in said casing body.

* * * * *